US005105798A

United States Patent [19]

Evens

[11] Patent Number: 5,105,798

[45] Date of Patent: Apr. 21, 1992

[54] HEATING EFFICIENCY AND NOISE REDUCTION ENCLOSURE

[75] Inventor: Lance J. Evens, Carrollton, Tex.

[73] Assignee: Lennox Industries Inc., Carrollton, Tex.

[21] Appl. No.: 741,100

[22] Filed: Aug. 6, 1991

[51] Int. Cl.[5] ..... F24H 3/02

[52] U.S. Cl. ..... 126/110 R

[58] Field of Search ..... 126/110 R, 116 R

[56] References Cited

U.S. PATENT DOCUMENTS

| | | | |
|---|---|---|---|
| 2,376,171 | 5/1945 | Mueller | 126/110 R |
| 2,376,172 | 5/1945 | Mueller | 126/116 R |
| 4,951,651 | 8/1990 | Shellenberger | 126/116 R |

FOREIGN PATENT DOCUMENTS

| | | | |
|---|---|---|---|
| 142144 | 8/1983 | Japan | 126/116 R |

*Primary Examiner*—Carroll B. Dority

*Attorney, Agent, or Firm*—Allegretti & Witcoff, Ltd.

[57] ABSTRACT

The present improvement is forced air furnaces comprises structure having redisposition of the vestibule panel of a forced air furnace from a location between the flue collector box and the circulating air flow to a location between the inducer motor and the induced draft fan housing. Advantages over prior art structures obtained by such forced air furnace structure having the novel disposition and location of the vestibule panel of the present invention is that the induced draft housing and the flue collector box are then located within the heated and enclosed circulating air flow chamber. One primary advantage of this structure is a significant decrease in noise emitted by the induced draft fan housing, and thus reduction of noise from the forced air furnace as a whole. Moreover, loss of heat from the induced draft housing and the flue collector box are prevented, while more beneficially disposing the inducer motor within the cooler environment of the vestibule area.

3 Claims, 1 Drawing Sheet

HEATING EFFICIENCY AND NOISE REDUCTION ENCLOSURE

BACKGROUND OF THE INVENTION

The present invention is directed to furnaces in general, and more particularly to an improvement in the disposition of the elements of a forced air furnace.

In the prior art, heating efficiency and noise level have been two very important considerations in forced air furnaces. In fact, even very small improvements in either or both of these characteristics have lent great desirability and competitive advance to the furnaces improved thereby. Although some improvements have been made in these areas, additional improvement has been deemed a highly desirable goal for furnace manufacturers.

An example of one type of prior art forced air furnace structure is shown in U.S. Pat. No. 4,951,651 to Schellenberger, wherein the vestibule panel is shown to enclose the flue collector box within the circulating air flow chamber. However, the vestibule panel does not enclose the induced draft fan housing within the circulating air flow chamber, but rather the induced draft fan housing is contained within the vestibule portion of the furnace. In such an environment, the level of noise from the induced draft fan housing is not and cannot be dampened without resort to extraordinary means, as it is located in the vestibule area of the furnace. Yet additionally, the induced draft fan housing cannot contribute any amount of heat to the circulating air flow chamber, but rather serves detrimentally as a drain for loss of heat and heating efficiency from the forced air furnace. These losses in heating efficiency, and increases in noise level have proved to be serious detriments and deficiencies in such prior art structures.

In view of the above defects, difficulties and deficiencies of even the most recently developed prior art structures, it is a material object of the present invention to provide a structure which will increase heating efficiency, while simultaneously decreasing the noise level emanating from the draft fan housing, thereby to provide lower cost heating and a reduced decibel level in the vicinity of such forced air furnace.

These and other objects of the improved heating efficiency and noise reduction enclosure invention hereof will be understood by those skilled in the art upon review of the following summary of the invention, brief description of the drawing, detailed description of preferred embodiments, appended claims and accompanying drawing.

SUMMARY OF THE INVENTION

The present improvement in forced air furnaces is directed to novel structure having a redisposition of the vestibule panel of a forced air furnace from a prior location between the flue collector box and the circulating air flow to a location between the inducer motor and the induced draft housing.

Advantages over prior art structures obtained by such new disposition and location of the vestibule panel include the benefits that the induced draft housing and the flue collector box are then located within the circulating air flow chamber. Accordingly, loss of heat from the induced draft housing and the flue collector box are prevented, while disposing the inducer motor within the cooler environment of the vestibule area.

BRIEF DESCRIPTION OF THE DRAWING

The improved heating efficiency and noise reduction enclosure structure of the present invention is depicted in the accompanying drawing, where like numerals refer to like elements in the various views, and in which.

DETAILED DESCRIPTION OF PREFERRED EMBODIMENTS

The improved heating efficiency and noise reduction enclosure apparatus of the present invention is directed to improvements in forced air furnaces. Such forced air furnaces fundamentally include an inducer motor with an adjacently disposed and connected induced draft fan housing. In certain embodiments, a flue collector box may be disposed adjacent the induced draft fan housing, but in other embodiments the flue collector box may also be located at some distance therefrom. The forced air furnace includes a vestibule panel for separating the heated circulating air flow chamber from the unheated vestibule area.

The heating efficiency of such forced air furnaces is increased and the level of noise emitting from such forced air furnace is reduced by means of the improved enclosure structure of the present invention. Specifically, the vestibule panel in the inventive enclosure structures is disposed between the inducer motor and the induced draft fan housing, so as to position the induced draft fan housing within the circulating air flow chamber.

In these and other embodiments of the improved heating efficiency and noise reduction enclosure structure of the present invention, the flue collector box may also preferably be disposed within the circulating air flow chamber. The flow of air in the circulating air chamber also in preferred embodiments contacts the surface of the flue collector box to derive heat therefrom, and thereby to prevent waste of such heat which would reduce heating efficiency. In such preferred embodiments, the AFUE efficiency of such structures has been found to be increased at least approximately 2.0%. In the field of endeavor of forced air heating furnaces, this level of increase in heating efficiency is considered by those skilled in such art to be substantial.

A further beneficial result of the improved enclosure structure of the present invention is a substantial decrease in operating noise. Yet another resulting benefit from such enclosure structure of the present invention is the retention of disposition of the inducer motor within the vestibule area which has a lower temperature than the area in the circulating air chamber, which is beneficial for the operation and operative life of the inducer motor.

Figure 1:
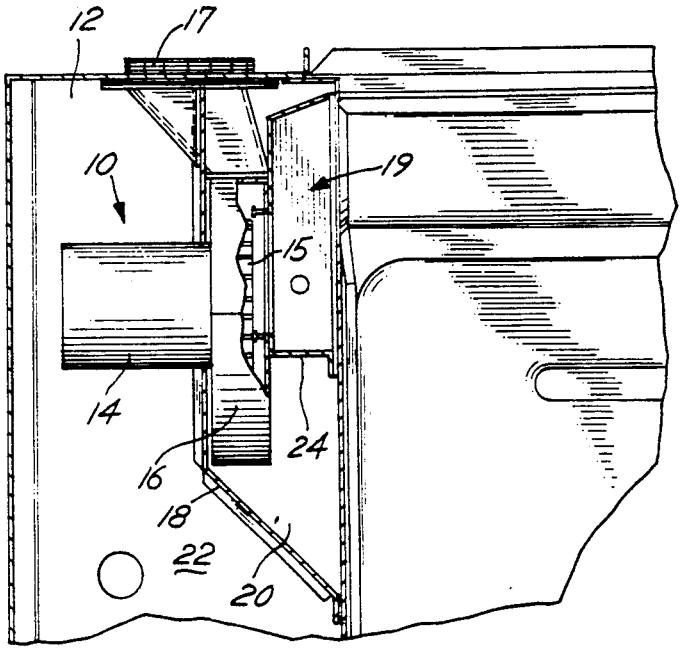
FIG. 1 is a longitudinal cross-sectional schematic view through a portion of a forced air furnace, and showing the inducer motor disposed exteriorly to the vestibule panel location of the present invention, and further showing the induced draft fan housing and the flue collector box disposed interiorly of such improved location for the vestibule panel, and in the air stream within the circulating air flow chamber, all for improved heating efficiency and reduction of noise.

Referring now to the drawing and to FIG. 1 in particular, the improved heating efficiency and noise reduction enclosure apparatus generally 10 of the present invention is directed to improvements in a forced air furnace generally 12. Forced air furnace 12 fundamentally includes an inducer motor 14 with an adjacently disposed and connected induced draft fan housing 16, within which is fan 15 driven by the inducer motor. In certain embodiments, a flue collector box 19 may be disposed adjacent induced draft fan housing 16, but in other embodiments it may also be located at some distance therefrom. It will be understood that the fuel (for example, gas) is mixed with air and burned in a combustion chamber (not shown) in the furnace 12. The combustion products are drawn from the combustion chamber through a heat exchanger by the induced draft fan 15 driven by inducer motor 14. The combustion products are then discharged from the furnace 12 through vent 17. Forced air furnace 12 includes a vestibule panel 18 for separating the heated circulating air flow chamber 20 from the unheated vestibule area 22. Of course, other forms of forced air furnaces similar to those shown in the FIGS. hereof are known to those skilled in the art, and the principles hereof are fully applicable thereto. The heating efficiency of forced air furnace 12 is substantially increased and the level of noise emitting from forced air furnace 12 is materially reduced by means of the improved enclosure structure 10 of the present invention. Specifically, vestibule panel 18 in the inventive enclosure structures is disposed between inducer motor 14 and induced draft fan housing 16, to render induced draft fan housing 16 then to be located within circulating air flow chamber 20.

Figure 2:
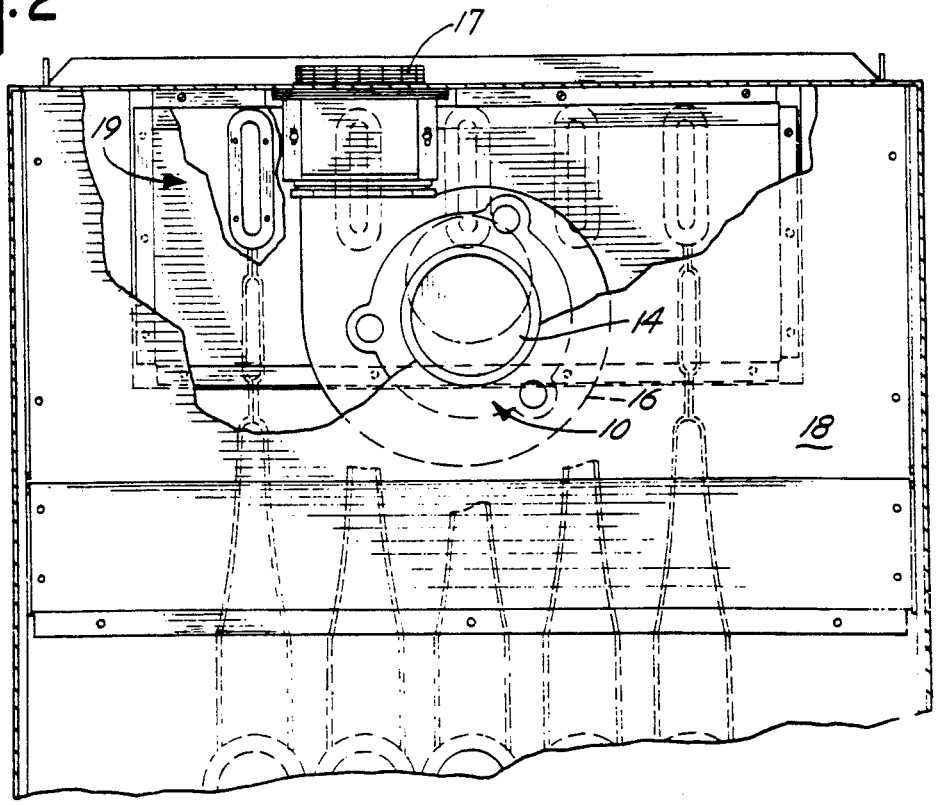
FIG. 2 is a schematic side view of a forced air furnace as shown in FIG. 1, showing the vestibule area, with the inducer motor disposed within the vestibule area, and the vestibule panel separating the inducer motor and the induced draft fan housing.

As shown in FIG. 1, improved heating efficiency and noise reduction enclosure structure 10 has flue collector box 18 disposed within circulating air flow chamber 20. The flow of air in the circulating air chamber 20 also contacts surface 24 of flue collector box 18 to derive heat therefrom, and thereby to prevent waste of such heat which would reduce heating efficiency. In the structure as shown in FIGS. 1 and 2, the AFUE efficiency has been found to be increased at least approximately 2.0%, as described more completely with regard to Example 1, infra.

A further beneficial result of improved enclosure structure 10 is a substantial decrease in operating noise. A yet further resulting benefit from such enclosure structure 10 is the disposition of the inducer motor 14 within vestibule area 22 that has a substantially lower temperature than the area in circulating air chamber 20 and which is beneficial for the operation and operative life of inducer motor 14.

EXAMPLE 1

The respective heating efficiencies of the prior art and improved structure of the present invention were compared. The equipment used was a 100,000 BTUH upflow gas furnace. The unit was tested for AFUE efficiency per ASHRAE 103 Standard. The AFUE was seen to increase at least approximately 2.0% with the improved construction.

EXAMPLE 2

The respective noise reduction of the prior art and the improved structure of the present invention were compared. The equipment used was again a 100,000 BTUH upflow gas furnace. The unit was tested for induced draft fan noise level in an anechoic sound room. The unit sound level was seen to decrease at least approximately 4 $db_A$ with the improved construction.

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. In a forced air furnace having an inducer motor driving an induced draft fan disposed in an adjacent induced draft fan housing, a flue collector box, in fluid communication with said fan housing and means forming a vestibule panel defining a circulating air flow chamber, about said fan housing and said flue connector box the heating efficiency and noise reduction improvement comprising:

said vestibule panel disposed between said inducer motor and said induced draft fan housing to render said induced draft fan housing within said circulating air flow chamber for increasing heating efficiency and reducing noise associated with said induced draft fan, and said flue collector box.

2. The heating efficiency and noise reduction improvement of claim 1 wherein the flow of air in said circulating air chamber contacts the surface of said flue collector box to derive heat therefrom.

3. The heating efficiency and noise reduction improvement of claim 1 including means forming a vestibule area in said furnace and wherein said inducer motor is disposed within said vestibule area of said forced air furnace, said vestibule area remaining relatively cooler than said circulating air chamber and wherein the AFUE efficiency is increased at least 2.0%.

* * * * *